US005459553A

United States Patent [19]

Kim

[11] Patent Number: 5,459,553

[45] Date of Patent: Oct. 17, 1995

[54] METHOD FOR ELIMINATING A PAPER JAM IN AN IMAGE FORMING SYSTEM

[75] Inventor: Sung-Eun Kim, Suwon, Rep. of Korea

[73] Assignee: SamSung Electronics Co., Ltd., Suwon, Rep. of Korea

[21] Appl. No.: 248,053

[22] Filed: May 24, 1994

[30] Foreign Application Priority Data

May 24, 1993 [KR] Rep. of Korea ..... 9002/1993

[51] Int. Cl.[6] ..... G03G 21/00

[52] U.S. Cl. ..... 355/203; 271/186; 355/205; 355/208; 355/309

[58] Field of Search ..... 355/206, 208, 355/209, 207, 316, 318, 319, 308–309, 205, 282, 295, 203; 271/259, 229, 186, 3.1

[56] References Cited

U.S. PATENT DOCUMENTS

| | | | |
|---|---|---|---|
| 4,054,380 | 10/1977 | Donohue . | |
| 4,143,960 | 3/1979 | Tracy . | |
| 4,231,567 | 11/1980 | Ziehm . | |
| 4,395,111 | 7/1983 | Takahashi et al. . | |
| 4,429,986 | 2/1984 | Abe et al. . | |
| 4,497,569 | 2/1985 | Booth . | |
| 4,540,274 | 9/1985 | Abuyama | 219/216 X |
| 4,627,711 | 12/1986 | Schron . | |
| 4,733,281 | 3/1988 | Yoshinaga . | |
| 4,786,041 | 11/1988 | Acquaviva . | |
| 4,878,428 | 11/1989 | Watarai . | |
| 4,967,239 | 10/1990 | Sakakura . | |
| 4,970,555 | 11/1990 | Obana | 355/207 |
| 5,003,346 | 3/1991 | Masuda . | |
| 5,010,363 | 4/1991 | Higashio et al. | 355/206 |
| 5,012,281 | 4/1991 | Kusumoto et al. | 355/206 |
| 5,030,991 | 7/1991 | Zaitsu et al. | 355/207 |
| 5,055,885 | 10/1991 | Yoshikado et al. | 355/318 |
| 5,058,879 | 10/1991 | Dunaway . | |
| 5,060,925 | 10/1991 | Hamakawa . | |
| 5,081,490 | 1/1992 | Wakao . | |
| 5,086,319 | 2/1992 | Carolan . | |
| 5,164,770 | 11/1992 | Furuichi . | |
| 5,182,597 | 1/1993 | Masuda . | |
| 5,257,070 | 10/1993 | Miller . | |
| 5,268,728 | 12/1993 | Sugiyama | 355/319 |
| 5,365,322 | 11/1994 | Hamada et al. | 355/316 |

*Primary Examiner*—A. T. Grimley
*Assistant Examiner*—T. A. Dang
*Attorney, Agent, or Firm*—Robert E. Bushnell

[57] ABSTRACT

A method for eliminating a paper jam from an image forming system is disclosed. The image forming system includes: an engine driving motor, register rollers for arranging paper received from a paper cassette, a register roller clutch for enabling and disabling transmission of rotational power from the engine driving motor to the register rollers, and fixing rollers for securing toner onto a surface of the paper and then delivering the paper to an exterior of the system. The paper jam elimination method includes the steps of: determining whether a paper jam has occurred, displaying an indication of the paper jam upon its detection, determining whether a paper jam elimination mode is activated, engaging register roller clutch upon activation of the paper jam elimination mode, and then activating engine driving motor to thereby deliver jammed paper to an exterior of the image forming system.

17 Claims, 5 Drawing Sheets

METHOD FOR ELIMINATING A PAPER JAM IN AN IMAGE FORMING SYSTEM

CROSS REFERENCE TO RELATED APPLICATIONS

This application makes reference to, incorporates herein and claims all benefits accruing under 35 U.S.C.§119 from our application earlier filed in the Korean Industrial Property Office on May 24, 1993 of our application entitled *METHOD FOR ELIMINATING A PAPER JAM OF AN IMAGE FORMING SYSTEM,* which application was duly assigned Ser. No. 9002/1993.

FIELD OF THE INVENTION

The present invention relates to an image forming system for recording images using electrophotographic developing processes, and more particularly, to a method and apparatus for automatically eliminating a paper jam.

BACKGROUND OF THE INVENTION

Electrophotographic developing processes are widely used in copiers, printers, facsimile machines and other instruments to generate an image corresponding to an electrical signal. An example of an electrophotographic developing printer is a laser beam printer (hereinafter referred to as an "LBP"). The general structure of an LBP using the electrophotographic developing process is disclosed in detail in U.S. Pat. No. 5,002,266 entitled "*Sheet Feed Apparatus for Image Forming System*" issued to Kikuchi et al. on Mar. 26, 1991.

Although electrophotographic developing processes have been extremely instrumental in the advent of the modern office, devices utilizing such processes have proven themselves to be disturbingly temperamental. One particular problem plaguing this art is the commonly occurring paper jam. Many efforts have been made to lessen the inconvenience of paper jams. One such effort is disclosed in U.S. Pat. No. 4,878,428 entitled *Control Method Of Transporting A Cut Sheet In A Printing Station And An Apparatus Using The Same,* issued to Watarai on Nov. 7, 1989. Watarai discloses a control method having steps of: detecting a paper jam in a feeding unit, stopping a transporting mechanism in the feeding unit, continuing operation of other transporting mechanism until sheets in printing and ejecting units are ejected, and then stopping the other transporting mechanism. Although this method has merit for avoiding toner contamination, I believe that the method can be improved upon.

A more recent effort at paper jam elimination is disclosed in U.S. Pat. No. 5,257,070 entitled *Selective Control Of Distributed Drives To Maintain Interdocument Gap During Jam Recovery Purge,* issued to Miller et al. on Oct. 26, 1993. Miller et al. disclose a method for systematically purging copy sheets from various zones of a paper path in a predetermined order based upon the particular disposition of the copy sheets in the paper path zones. Although this method appears effective, I have found that it is unnecessarily complex and that it can be simplified.

SUMMARY OF THE INVENTION

It is therefore an object of the present invention to provide an improved method for eliminating a paper jam from an image forming device.

It is another object to provide a paper jam elimination method that easily and effectively eliminates a paper jam from an image forming device.

It is still another object to provide a paper jam eliminating method that is easily implemented into an image forming device.

It is still another object to provide a paper jam elimination method that is capable of reducing noise, when eliminating a paper jam from an image forming device, and of protecting the image forming device.

It is still another object to provide a paper jam elimination method that prevents toner contamination to an image forming device when eliminating a paper jam from the image forming device.

It is yet another object to provide a paper jam elimination method that automatically eliminates a paper jam from an image forming device.

To achieve these and other objects, the present invention discloses a method for eliminating a paper jam from an image forming system. The image forming system includes: an engine driving motor, register rollers for arranging paper received from a paper cassette, a register roller clutch for enabling and disabling transmission of rotational power from the engine driving motor to the register rollers, and fixing rollers for securing toner onto a surface of the paper and then delivering the paper to an exterior of the system. The paper jam elimination method includes the steps of: determining whether a paper jam has occurred, displaying an indication of the paper jam upon its detection, determining whether a paper jam elimination mode is activated, engaging register roller clutch upon activation of the paper jam elimination mode, and then activating engine driving motor to thereby deliver jammed paper to an exterior of the image forming system.

BRIEF DESCRIPTION OF DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1A:
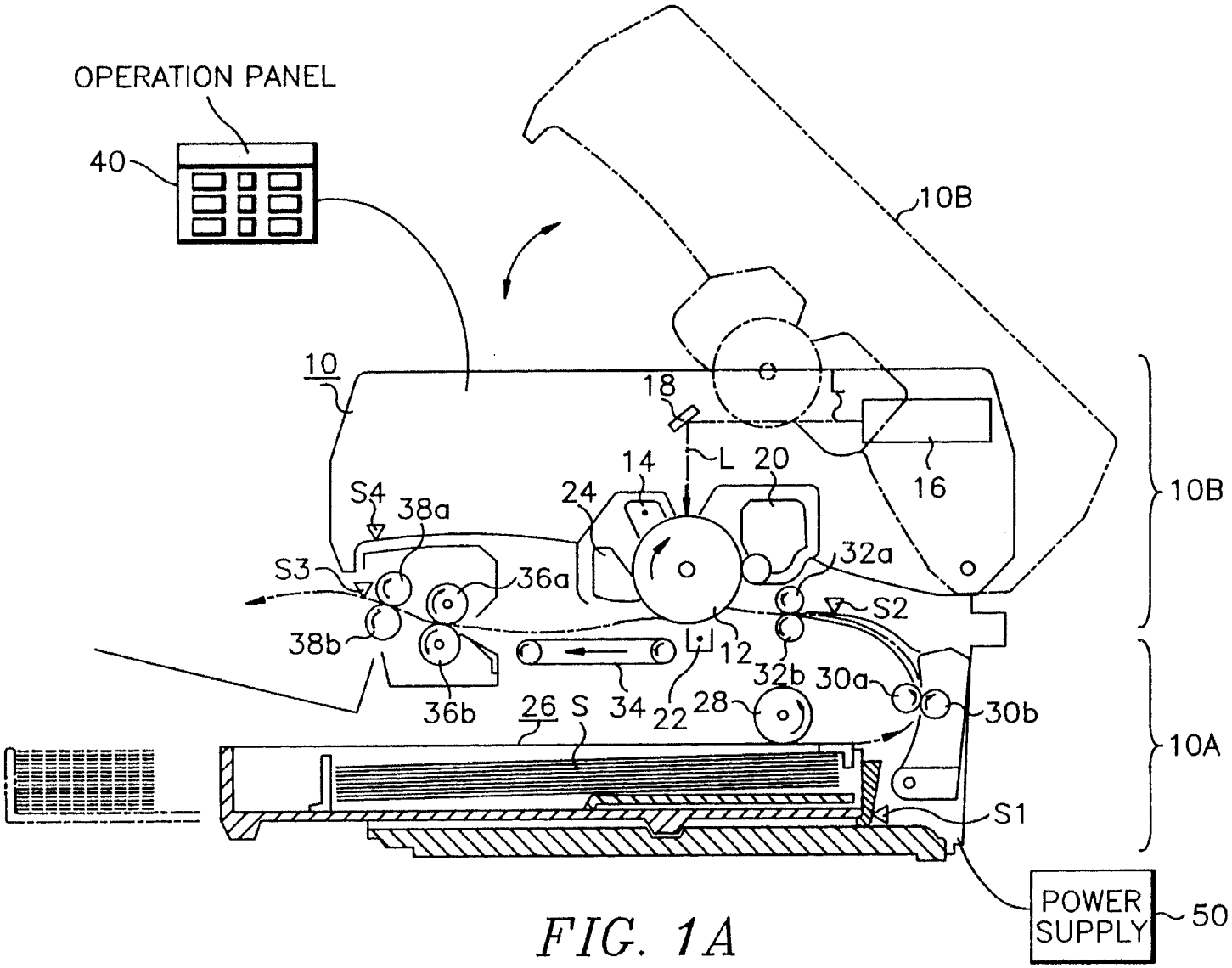
FIG. 1A is a longitudinal side view showing the print mechanism of a representative design for an electrophotographic developing unit, such as a printer.

Turning now to the drawings, the printer shown in FIG. 1 includes a housing 10 having a body 10A and a cover 10B. Cover 10B is pivotally mounted on body 10A and can be opened and closed from body 10A. A charger 14 forms a uniform charge on a photosensitive drum 12. A laser scanner unit 16 generates a laser beam L corresponding to image data and exposes photosensitive drum 12 through a laser reflecting mirror 18, thereby forming an electrostatic latent image. A developing unit 20 transmits toner to the electrostatic latent image formed on photosensitive drum 12. A pickup roller 28 (also known as a feed roller) picks up paper S stacked in a paper cassette 26. Conveyor rollers 30*a* and 30*b* convey paper picked up by pickup roller 28 to register rollers 32*a* and 32*b*. Register rollers 32*a* and 32*b*, controlled by a register roller clutch (not shown) of any suitable type known in the art, arrange the paper conveyed by pickup roller 28 and convey rollers 30*a* and 30*b*. Register roller clutch acts as a power conveyance device, enabling transmission of rotational power from an engine driving motor to register rollers 32*a* and 32*b* by providing a power conveyance path between engine driving motor and register rollers 32*a* and 32*b*. A transfer unit 22 transfers developing material (toner) formed on photosensitive drum 12 to the paper. A cleaner 24 removes residual toner from the surface of photosensitive drum 12 after toner image transfer. A conveyor belt 34 then conveys paper from transfer unit 22 to fixing rollers 36*a* and 36*b*. Fixing rollers 36*a* and 36*b* subsequently fix toner on the paper. Delivery rollers 38*a* and 38*b* ultimately eject the image-formed paper to the exterior of the printer. Also included is an operation panel 40 having a plurality of keys for controlling operation of the printer and a variable visual display for indicating the presence of a paper jam and a power supply 50 for providing power to the printer.

In a conventional printer such as the one shown in FIG. 1A, register rollers 32*a* and 32*b* are connected to an engine driving motor via a register roller clutch, and delivery rollers 38*a* and 38*b*, fixing rollers 36*a* and 36*b*, and conveyor belt 34 are directly connected to the engine driving motor by a gear belt. Hence, the delivery rollers 38*a* and 38*b*, fixing rollers 36*a* and 36*b*, and conveyor belt 34 are rotated as the engine driving motor is driven, the register rollers 32*a* and 32*b* never rotate until the register roller clutch is driven.

Figure 1B:
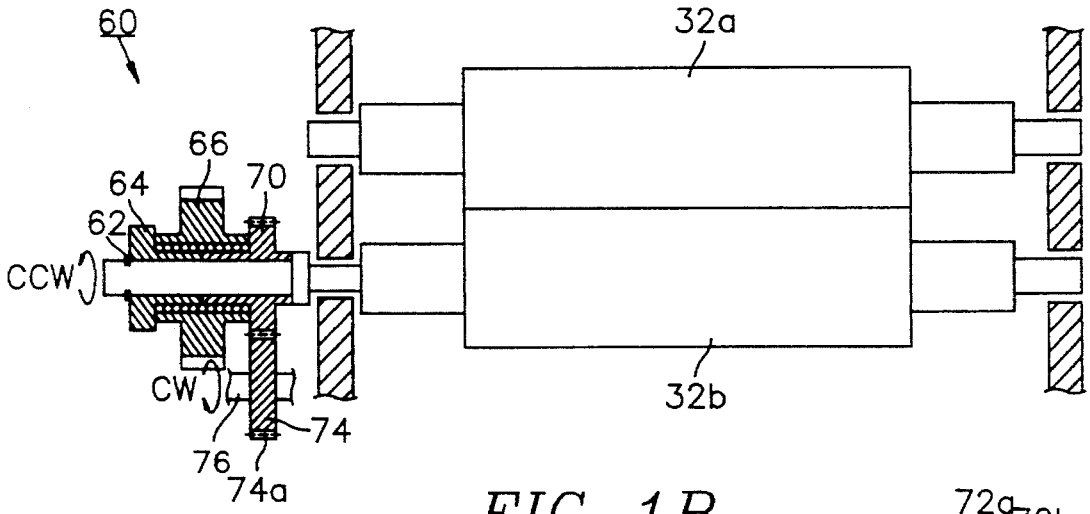
FIG. 1B is a sectional view showing an assembled state of register roller clutch.
Figure 1C:
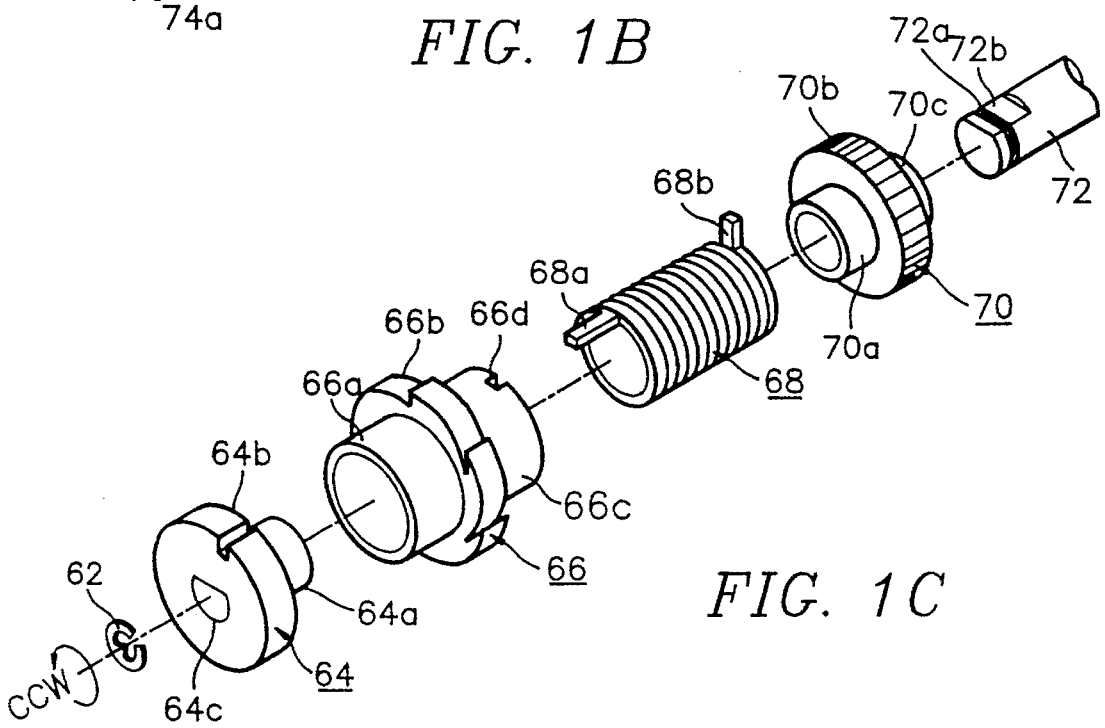
FIG. 1C is an exploded perspective view, of the register roller clutch.

One type of register roller clutch is disclosed in U.S. Pat. No. 5,141,217, assigned to the same Assignee as the present invention, entitled *DEVICE FOR FEEDING PAPER FOR USE IN A FACSIMILE FILED*, filed in the United States Patent & Trademark Office on Jun. 7, 1990 and there assigned Ser. No. 07/534,238. FIG. 1B is a sectional view showing an assembled state of register rollers 32*a* and 32*b* and a typical register roller clutch 60 associated with FIG. 1A. FIG. 1C is an exploded perspective view of register roller clutch 60 using a common spring. Referring to FIGS. 1B and 1C, a driving shaft 72 of register roller 32*b* is positioned at a lower portion of register rollers 32*a* and 32*b*, and is provided with register roller clutch 60. An E-shaped ring 62 to be inserted into a recess 72*a* of driving shaft 72 of register roller 32*a* serves to stably install register roller clutch 60 into driving shaft 72. A bushing 64 having a cylindrical portion 64*a* and a notch portion 64*b* is fixed at an end portion of driving shaft 72 of register roller 32*b* by engaging D-shaped opening 64*c* of bushing 64 with a notched portion 72*b* of driving shaft 72. A driving gear 70 having cylindrical portions 70*a* and 70*c* at both sides thereof and a toothed-gear 70*b* is loosely installed on driving shaft 72 of register roller 32*b* and is freely rotatable. Cylindrical portions 64*a* and 70*a*, having the same diameter, maintain contact while facing each other. Cylindrical portions 64*a* and 70*a* are encircled by a clutch spring 68 having two extended ends 68*a* and 68*b* which are inserted into notch portions 64*b* and 66*d*, respectively. An internal diameter of clutch spring 68 is somewhat smaller than an external diameter of cylindrical portions 64*a* and 70*a*, and clutch spring 68 is installed by being slightly inserted into cylindrical portions 64*a* and 70*a*. A bushing 66 having cylindrical portions 66*a* and 66*c*, notch 66*d*, and a plurality of edges 66*b* is loosely installed at the exterior of clutch spring 68 in order to be freely rotatable. An internal diameter of cylindrical portions 66*a* and 66*c* is somewhat larger than an external diameter of clutch spring 68. Toothed-gear 70*b* of driving gear 70 is engaged with a gear 74*a* of a driving gear 74 installed at driving shaft 76 of the engine driving motor, so that driving gear 70 is rotated in accordance with rotation of the engine driving motor.

Figure 1D:
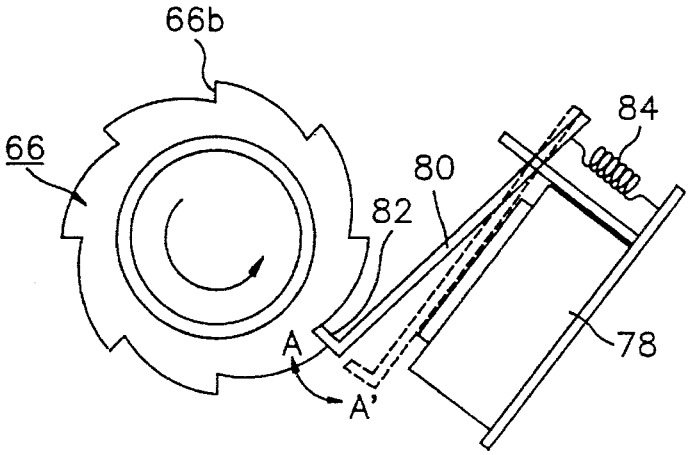
FIG. 1D is aside view showing latched and unlatched states of the register roller clutch.

Now referring to FIG. 1D, edge 66*b* of bushing 66 is held or released by a catch 82 formed at one end of an arm 80 being operated by a solenoid 78. Between the other end of arm 80 and a printer frame is provided a tension spring 84. When the register roller clutch 60 is driven, a controller of the printer energizes solenoid 78, and when register roller clutch 60 is not driven, a controller of the printer de-energizes solenoid 78. When the solenoid 78 is energized, edge 66*b* of bushing 66 is released from catch 82 as arm 80 is drawn in the direction of A', thereby enabling rotation of bushing 66. When solenoid 78 is de-energized, edge 66*b* of bushing 66 is held by catch 82 as arm 80 is pushed in the direction of A by a tension spring 84, thereby prohibiting bushing 68 from being rotated.

An explanation of the operation of register roller clutch 60 will be hereinafter described. When the engine driving motor is driven, driving shaft 76 rotates in a clockwise direction. In this case, driving gear 70 rotates in counterclockwise direction, and clutch spring 68 rotates in a counterclockwise direction according to cylindrical portion 70*a*.

If register roller clutch 60 is in a driving state, that is, bushing 66 is in a rotatable state, the internal diameter of clutch spring 68 becomes smaller and smaller as the clutch spring 68 rotates in the counterclockwise direction. Therefore, cylindrical portions 64*a* and 70*a* are tightly joined by clutch spring 68. Driving force of the engine driving motor is transmitted in the following sequence from driving gear 70 to clutch spring 68, to bushing 66, to driving shaft 72 by D-shaped opening 64*c* of bushing 64 and notch 72*b* of driving shaft 72. Thereafter, as register roller 32*b* rotates in the counterclockwise direction, paper is conveyed to a transfer unit 22.

On other hand, if register roller clutch 60 is not in a driving state, that is, the bushing 66 is not in a rotatable state, even though driving gear 70 rotates in accordance with activation of engine driving motor, clutch spring 68 does not rotate. As a result, register rollers 32*a* and 32*b* do not rotate.

In a typical printer, sensors for determining the operational state of each portion of the printer and the conveyance state of paper are installed. FIG. 1 shows four sensors S1–S4 for performing such functions. A first sensor S1, installed to contact a front end of paper cassette 26 on the inside of body 10A, senses the removal and insertion state of paper cassette 26. A second sensor S2, installed in a paper conveyance path between conveyor rollers 30*a* and 30*b* and register rollers 32*a* and 32*b*, senses the conveyance state of paper conveyed from paper cassette 26 to register rollers 32*a* and 32*b*. A third sensor S3, installed in a paper delivery path extending from delivery rollers 38*a* and 38*b*, senses the delivery state of paper. A fourth sensor S4, installed on one side of cover 10B opposite from body 10A, senses the opening and closing state of cover 10B.

Figure 2:
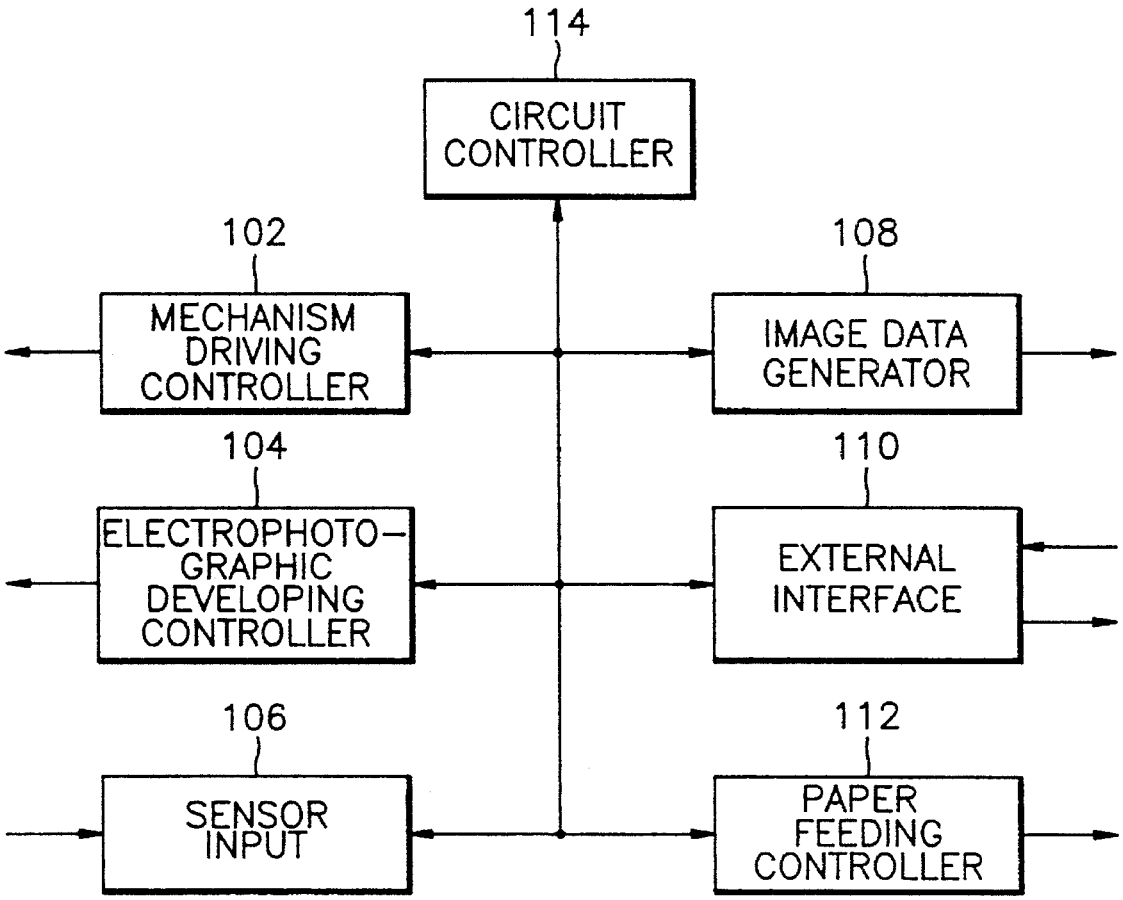
FIG. 2 is a block diagram showing an engine control circuit of a representative design for an electrophotographic developing unit.

FIG. 2 shows a block diagram of a control circuit for controlling an engine of the printer of FIG. 1. The control circuit is disclosed in Korean Patent application No. 92-11243, and in a copending application entitled *METHOD AND APPARATUS FOR CONTROLLING A PRINT ENGINE OF A PAPER PRINTER,* filed in the United States Patent & Trademark Office on Jun. 28, 1993 and there assigned Ser. No. 08/082,917, both assigned to the same assignee as the present invention. A mechanism driving controller 102 controls the drive of mechanical parts including the various rollers shown in HG. 1. An electrophotographic developing controller 104 controls the development of an electrophotograph. A sensor input 106 receives outputs from various sensors, including the four sensors S1–S4 of FIG. 1, and applies the outputs to a circuit controller 114. An image data generator 108 generates image data and transmits the image data to a laser scanner unit 16. An external interface 110 interfaces signals received from an external control system (not shown). A paper feeding controller 112 controls the feed of paper. Circuit controller 114 carries out various functions of the printer by controlling each portion of the printer, including a mechanism driving controller 102, electrophotographic developing controller 104, image data generator 108, external interface 110 and paper feeding controller 112 in response to input signals from sensor input 106 and external interface 110. Typically, circuit controller 114 uses a microcomputer and implements an internal program to control each portion of the printer, thereby performing various functions of the printer.

A brief description of a printing process useful in understanding the present invention will now be given with reference to FIGS. 1 and 2.

When the circuit of FIG. 2 begins operation, circuit controller 114 controls electrophotographic developing controller 104 to initialize the printer to a printing state and to execute a standby mode for determining whether or not a print command is received from the control system through external interface 112. During the standby mode, circuit controller 114 begins the printing operation in response to a print command. Circuit controller 114 sequentially operates photosensitive drum 12, charger 14, developing unit 20, transfer unit 22, laser scanner unit 16, and other components by driving the engine driving motor. Engine driving motor drives photosensitive drum 12, charger 14, developing unit 20, transfer unit 22, laser scanner unit 16, and other components. Paper is then fed from paper cassette 26 to implement the printing operation. Paper fed by pickup roller 28 from paper cassette 26 is arranged in register rollers 32*a* and 32*b* through conveyor rollers 30*a* and 30*b* and second sensor S2. The arranged paper is then conveyed to transfer unit 22, and an image formed on photosensitive drum 12 developed through developing unit 20 is transferred onto the paper conveyed to transfer unit 22. Thereafter, the paper is conveyed to fixing rollers 36*a* and 36*b*, and toner is affixed to the paper by a thermal effect produced by fixing rollers 36*a* and 36*b*. The paper is then delivered through delivery rollers 38*a* and 38*b* and third sensor S3. If the printing operation is terminated, circuit controller 114 stops operation of engine driving motor and again proceeds to the standby mode.

During the printing operation described above, there is an occasional mishap of paper becoming jammed within the printer. Such occurrences can be the result of paper condition or equipment malfunction. In either case, paper jams are both frustrating and inconvenient.

Typically, in the case of a paper jam, the printer automatically senses the paper jam and then informs a user of its occurrence.

Figure 3:
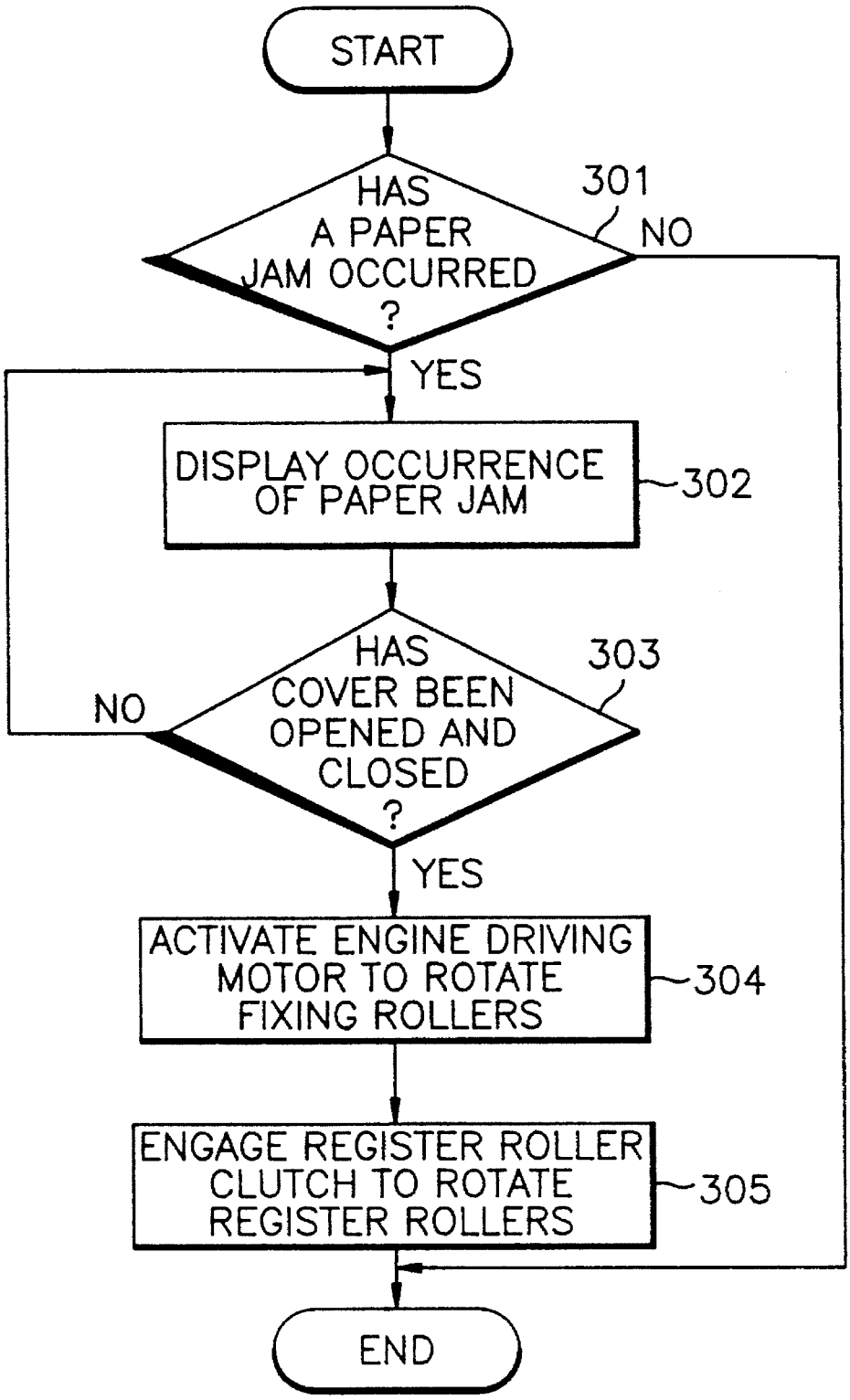
FIG. 3 is a flow chart showing a simplified abstract representation of a conventional paper jam eliminating process.

FIG. 3 illustrates a conventional method for eliminating a paper jam from an image forming device. Referring to FIG. 3, circuit controller 114 determines, in step 301, the existence of a paper jam. When a paper jam has occurred, an indication of its existence is displayed on a variable visual display of operation panel 40 in step 302. In step 303, circuit controller 114 determines whether or not cover 10B of the printer is opened and closed. The opening and closing of cover 10B is sensed by fourth sensor S4. In order to automatically eliminate the paper jam, the user initiates a paper jam eliminating mode by opening and closing cover 10B. Alternatively, some printing devices provide that the paper jam eliminating mode be initiated by pressing a predetermined key on operation panel 40 or by switching power supply 50 off then on. In either case, circuit controller 114 responds to initiation of the paper jam eliminating mode by rotating fixing rollers 36*a* and 36*b* through activation of engine driving motor in step 304. In step 305, circuit controller 114 activates a power conveyance path between engine driving motor and register rollers 32*a* and 32*b* upon engagement of register roller clutch 60, thereby enabling rotation of register rollers 32*a* and 32*b*. Accordingly, paper in the paper conveyance path is delivered, and the paper jam is eliminated. Thereafter, circuit controller 114 terminates operation of engine driving motor and again proceeds to the standby mode.

In the conventional method described above, fixing rollers 36*a* and 36*b* rotate upon activation of the engine driving motor. However, in a situation where the engine driving motor is activated, but register roller clutch 60 is not engaged, register rollers 32*a* and 32*b* cannot rotate since rotational force from the engine driving motor is not transmitted to register rollers 32*a* and 32*b*.

As mentioned above problems are created by driving the engine driving motor prior to register roller clutch 60. If a paper jam simultaneously occurs between register rollers 32*a* and 32*b* and another set of rollers such as fixing rollers 36*a* and 36*b*, the paper cannot be conveyed to fixing rollers 36*a* and 36*b* because register rollers 32*a* and 32*b* do not rotate until register roller clutch 60 drives after driving the engine driving motor. In this case, noise is generated by friction between the paper and a corresponding roller. Further, the paper is likely to tear when the paper is thin or the strength of the paper is weak. If the paper tears, an image forming device risks damage because crumpled paper remains in the interior of the image forming device, so that a user must open unit cover 10B and manually remove the paper jam. In this case, the user's hands and/or the image forming device become contaminated due to toner which is not completely fixed on the paper.

Further, assume that register roller clutch 60, such as the spring clutch shown in FIG. 1C is used when a paper jam occurs between fixing rollers 36*a* and 36*b* and register rollers 32*a* and 32*b*. If the engine driving motor is activated and register roller clutch 60 is engaged thereafter, register roller clutch 60 does not engage smoothly. That is, when fixing rollers 36*a* and 36*b* rotate via the engine driving motor and register roller clutch 60 is not engaged, paper is conveyed solely pursuant to rotation of fixing rollers 36*a* and 36*b*, since register rollers 32*a* and 32*b* are not able to rotate accordingly. Therefore, rotational force from fixing rollers 36*a* and 36*b* is transmitted to register roller clutch 60 via the paper and register rollers 32*a* and 32*b*. After engine driving motor is activated, even if register roller clutch 60 is engaged to enable rotation of register rollers 32*a* and 32*b*, register roller clutch does not engage smoothly. That is, if register roller clutch 60 is not driven, as shown in FIG. 1D, bushing 66 cannot rotate because edge 66*b* of bushing 66 is restrained by catch 82. In such a situation, since fixing rollers 36*a* and 36*b* are driven via rotation of the engine driving motor, the paper is pulled toward fixing rollers 36*a* and 36*b*. Therefore, register roller 32*b* and bushing 66 rotate in the counterclockwise direction, so that edge 66*b* of bushing 66 is restrained by catch 82. Here, when solenoid 78 is energized to enable rotation of register roller clutch 60, solenoid 78 pulls arm 80 in the A' direction. However, since edge 66*b* of bushing 66 is restrained by catch 82 arm 80 is not activated smoothly. As a result, since register roller clutch 60 is not driven, register rollers 32*a* and 32*b* cannot rotate. As a result, register rollers 32*a* and 32*b* are not rotated and the paper jam is not eliminated. In such a situation, the user experiences the inconvenience of having to open unit cover 10B and manually remove the paper jam.

Figure 4:
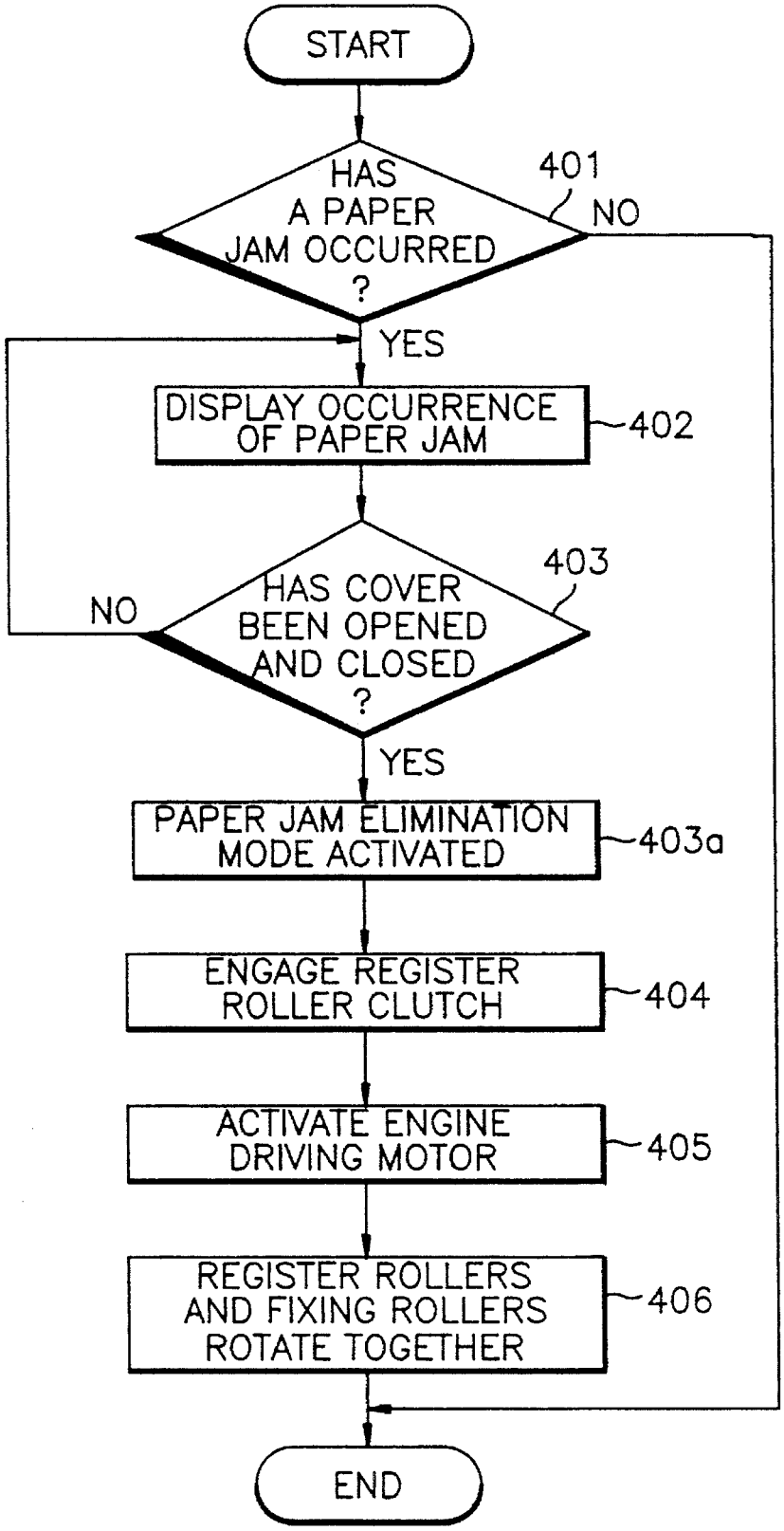
FIG. 4 is a flow chart showing a paper jam eliminating process performed according to the principles of the present invention.

FIG. 4 is a flow chart showing a paper jam eliminating process performed according to the principles of the present invention. This process will now be explained with reference to FIGS. 1, 2, and 4. In step 401, circuit controller 114 determines whether a paper jam has occurred. If a paper jam has occurred, its occurrence is indicated by the variable visual display on operation panel 40 of the printer at step 402. Next, in step 403, circuit controller 114 determines whether cover 10B of the printer has been opened and closed. If cover 10B has not been opened and closed, indication of the paper jam continues to be displayed on operation panel 40 and circuit controller 114 continues to detect whether cover 10B is opened and closed. Once cover 10B is opened and closed, a paper jam elimination mode is activated in step 403*a* to prepare for removal of the paper jam. Instead of opening and closing cover 10B, design options allow the paper jam elimination mode to also be activated by either inputting a predetermined key on operation panel 40 or by switching power supply 50 off then on. In response to the paper jam elimination mode, register roller clutch is engaged in step 404. Circuit controller 114 then activates the power conveyance path between engine driving motor and register rollers 32*a* and 32*b* to enable rotation of register rollers 32*a* and 32*b*. In step 405, circuit controller 114 activates engine driving motor to rotate fixing rollers 36*a* and 36*b*. Therefore, fixing rollers 36*a* and 36*b* and register rollers 32*a* and 32*b* rotate together in step 406.

Therefore, when a paper jam occurs between fixing rollers 36*a* and 36*b* and register rollers 32*a* and 32*b*, since fixing rollers 36*a* and 36*b* and register rollers 32*a* and 32*b* rotate together, the jammed paper is easily delivered to the exterior of the printer and the paper jam is quickly eliminated.

Further, there is provided a paper jam elimination method for an image forming device that is capable of reducing noise, as well as protect both the image forming device and a user's hands from contamination due to toner which is not completely fixed on the paper. In addition, the user doesn't need to manually remove jammed paper because the paper jam is automatically eliminated.

From the aforementioned description, one can see that the present invention is capable of easily eliminating a paper jam by engaging register roller clutch 60 prior to activating the engine driving motor.

While the above description and accompanying drawings represent a preferred embodiment of the present invention, it will be apparent to those skilled in the art that various changes and modifications may be made therein without departing from the spirit and scope of the present invention, as defined by the appended claims. Although the disclosed embodiment of the present invention is applied to an LBP, it is also possible to apply the present invention to a copier, LPH (light emitting diode printer head) printer, facsimile or other device using an electrophotographic developing process.

Additionally, the disclosed embodiment of the present invention is applied to a situation where a paper jam occurs during an actual printing operation. However, it is also appreciated that the present invention may also be applied to a situation where a paper jam occurs during initiation of the printing operation. Accordingly, the scope of the present invention is not defined solely by the disclosed embodiment, but rather by the scope of the appended claims and the equivalent thereof.

What is claimed is:

1. A method for eliminating a paper jam from an image forming system having an engine driving motor, paper registration means for arranging paper received from a paper cassette, power conveyance means for enabling transmission of rotational power from said engine driving motor to said paper registration means, and fixing means for securing developing material onto a surface of the paper and then delivering the paper to an exterior of said system, said method comprising the steps of:

engaging said power conveyance means in response to activation of a paper jam elimination mode;

activating said engine driving motor after said power conveyance means are engaged; and delivering jammed paper to said exterior of said system by rotating said paper registration means and said fixing means following activation of said engine driving motor to eliminate the paper jam.

2. The method for eliminating a paper jam as claimed in claim 1, wherein said engagement of said power conveyance means provides a power conveyance path distributing kinetic energy between said engine driving motor and said paper registration means.

3. The method for eliminating a paper jam as claimed in claim 1, further comprised of said paper jam elimination mode being activated by one of opening and closing a cover of said system, pressing a predetermined key on an operation panel, and switching a system power supply off then switching the power supply on.

4. A method for eliminating a paper jam from an image forming system having an engine driving motor, register rollers for arranging paper received from a paper cassette, a register roller clutch for enabling transmission of rotational power from said engine driving motor to said register rollers, and fixing rollers for securing developing material onto a surface of the paper and then delivering the paper to an exterior of said system, said method comprising the steps of:

providing a power conveyance path distributing kinetic energy between said engine driving motor and said register rollers by engaging said register roller clutch in response to activation of a paper jam elimination mode; and delivering jammed paper to said exterior of said system by rotating said register rollers and said fixing rollers following activation of said engine driving motor to eliminate the paper jam.

5. The method for eliminating a paper jam as claimed in claim 4, further comprised of said paper jam elimination mode being activated by one of opening and closing a cover of said system, pressing a predetermined key on an operation panel, and switching a system power supply off then switching the power supply on.

6. A method for eliminating a paper jam from an image forming system having an engine driving motor, register rollers for arranging paper received from a paper cassette, a register roller clutch for enabling transmission of rotational power from said engine driving motor to said register rollers, and fixing rollers for securing developing material onto a surface of the paper and then delivering the paper to an exterior of said system, said method comprising the sequential steps of:

determining when the paper jam occurs;

providing a variable visual display indicative of the paper jam when the paper jam occurs;

determining whether a paper jam elimination mode has been activated;

engaging said register roller clutch upon activation of said paper jam elimination mode; and activating said engine driving motor after said register roller clutch is engaged, said engaging and activating steps enabling said register rollers and said fixing rollers to rotate together.

7. The method for eliminating a paper jam as claimed in claim 6, further comprised of said paper jam elimination mode being activated by one of opening and closing a cover of said system, pressing a predetermined key on an operation panel, and switching a system power supply off then on.

8. An apparatus for removing jammed paper from within an image forming system, said apparatus comprising:

register rollers for arranging paper received from a paper cassette;

fixing rollers for securing developing material upon a surface of the paper before delivering the paper to an exterior of the system;

engine driving means for providing rotational power to said fixing rollers; and a register roller clutch for enabling transmission of said rotational power from said engine driving means to said register rollers, said register roller clutch becoming engaged upon activation of a paper jam elimination mode, said register roller clutch becoming engaged before said engine driving means provides said rotational power to said fixing rollers so that said register rollers and said fixing rollers rotate together to remove the jammed paper.

9. The apparatus for removing jammed paper as claimed in claim 8, further comprised of said paper jam elimination mode being activated by one of opening and closing a cover of said system, pressing a predetermined key on an operation panel, and switching a system power supply off then on.

10. The apparatus for removing jammed paper as claimed in claim 8, wherein said register roller clutch provides transfer of said rotational power from said engine driving means to said register rollers through a power conveyance path distributing kinetic energy between said engine driving means and said register rollers.

11. The method for eliminating a paper jam as claimed in claim 1, further comprised of said paper jam elimination mode being activated in response to detection of the paper jam.

12. The method for eliminating a paper jam as claimed in claim 11, further comprising a step of providing a variable visual display indicative of an occurrence of the paper jam when the paper jam occurs.

13. The method for eliminating a paper jam as claimed in claim 1, wherein said power conveyance means comprise a register roller clutch.

14. The method for eliminating a paper jam as claimed in claim 1, wherein said paper registration means comprise register rollers.

15. The method for eliminating a paper jam as claimed in claim 4, further comprised of said paper jam elimination mode being activated in response to detection of the paper jam.

16. The method for eliminating a paper jam as claimed in claim 15, further comprising a step of providing a variable visual display indicative of the paper jam when the paper jam occurs.

17. The apparatus for removing jammed paper as claimed in claim 8, further comprising variable visual display means for providing a visual indication of a paper jam when the paper jam occurs.

* * * * *

UNITED STATES PATENT AND TRADEMARK OFFICE

CERTIFICATE OF CORRECTION

PATENT NO. : 5,459,553
DATED : October 17, 1995
INVENTOR(S) : Sung-Eun Kim

It is certified that error appears in the above-indentified patent and that said Letters Patent is hereby corrected as shown below:

Column 1,

Line 46 before "until", change "mechanism" to --mechanisms--;

Line 47 after "transporting" change "mechanism" to --mechanisms--;

Column 2,

Line 47 after "view" delete ",";

Column 4

Line 18 before "register" delete "the";

Line 40 after "sequence" insert ":":

Signed and Sealed this
First Day of October, 1996

Bruce Lehman

*Attest:*

BRUCE LEHMAN

*Attesting Officer*

*Commissioner of Patents and Trademarks*